US008532515B2

(12) United States Patent
Adachi et al.

(10) Patent No.: US 8,532,515 B2
(45) Date of Patent: Sep. 10, 2013

(54) IMAGE FORMING APPARATUS

(75) Inventors: Motoki Adachi, Ashigarakami-gun (JP); Kentaro Kawata, Suntou-gun (JP); Takayuki Kanazawa, Suntou-gun (JP); Masanori Tanaka, Yokohama (JP); Shunsuke Mizukoshi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 13/371,680

(22) Filed: Feb. 13, 2012

(65) Prior Publication Data

US 2012/0155903 A1 Jun. 21, 2012

Related U.S. Application Data

(63) Continuation of application No. PCT/JP2011/068721, filed on Aug. 12, 2011.

(30) Foreign Application Priority Data

Aug. 19, 2010 (JP) ..... 2010-184267

(51) Int. Cl.
*G03G 15/16* (2006.01)

(52) U.S. Cl.
USPC ..... 399/66; 399/121; 399/154; 399/297; 399/302

(58) Field of Classification Search
USPC ..... 399/66, 121, 154, 297, 302
See application file for complete search history.

(56) References Cited

U.S. PATENT DOCUMENTS 5,471,286 A 11/1995 Tanaka
5,628,406 A 5/1997 Yoshida et al.
5,640,645 A 6/1997 Namekata et al.
6,192,205 B1 2/2001 Motohashi
6,421,512 B2 7/2002 Watanabe et al.
6,421,516 B1 7/2002 Kinoshita et al.
6,640,063 B2 10/2003 Adachi et al.

(Continued)

FOREIGN PATENT DOCUMENTS

JP 7-225520 A 8/1995
JP 10-239936 A 9/1998

(Continued)

OTHER PUBLICATIONS

Forms PCT/ISA/210 and PCT/ISA/237 issued in International Application No. PCT/JP2011/068721.

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus is operable in a mode in which a speed of an intermediary transfer belt is changed after all of the toner images are primary-transferred onto the intermediary transfer belt, and the toner image primary-transferred on the intermediary transfer belt is passed through a secondary transfer position and primary transfer position in this order to reach the secondary transfer position, where the toner image is secondary transferred onto the transfer material, and a controller for making, before the image forming apparatus is operated in the mode to change the speed of the intermediary transfer belt, a potential difference between the intermediary transfer belt and the photosensitive member at the primary transfer position smaller than a potential difference between the intermediary transfer belt and the photosensitive member when the toner image is primary transferred from the photosensitive member onto the intermediary transfer belt.

9 Claims, 7 Drawing Sheets

(56) References Cited

U.S. PATENT DOCUMENTS

| | | | | |
|---|---|---|---|---|
| 6,807,384 | B2 | 10/2004 | Okubo et al. | |
| 6,928,253 | B2 | 8/2005 | Ojima et al. | |
| 6,950,620 | B2 | 9/2005 | Yoshikawa et al. | |
| 6,963,707 | B2 | 11/2005 | Kinoshita et al. | |
| 6,999,690 | B2 | 2/2006 | Watanabe et al. | |
| 7,058,338 | B2 | 6/2006 | Ojima et al. | |
| 7,095,966 | B2 | 8/2006 | Adachi | |
| 7,194,226 | B2 | 3/2007 | Adachi et al. | |
| 7,209,690 | B2 | 4/2007 | Koyanagi et al. | |
| 7,286,788 | B2 | 10/2007 | Kinoshita et al. | |
| 7,457,554 | B2 | 11/2008 | Matsuda et al. | |
| 7,711,279 | B2 | 5/2010 | Matsuda et al. | |
| 8,150,301 | B2 | 4/2012 | Adachi et al. | |
| 8,155,539 | B2 | 4/2012 | Kawasaki et al. | |
| 2004/0218938 | A1* | 11/2004 | Ono et al. | 399/45 |
| 2008/0075489 | A1* | 3/2008 | Hayashi | 399/45 |
| 2010/0054803 | A1 | 3/2010 | Kawaguchi et al. | |
| 2011/0268468 | A1 | 11/2011 | Adachi et al. | |

FOREIGN PATENT DOCUMENTS

| | | | |
|---|---|---|---|
| JP | 2000-172046 | A | 6/2000 |
| JP | 2000-172082 | A | 6/2000 |
| JP | 2003-207981 | A | 7/2003 |
| JP | 2009-204809 | A | 9/2009 |
| JP | 2010-176154 | A | 8/2010 |

* cited by examiner

IMAGE FORMING APPARATUS

This application is a continuation of International Application No. PCT/JP2011/068721, filed Aug. 12, 2011.

TECHNICAL FIELD

The present invention relates to an electrophotographic type image forming apparatus such as a printer, a facsimile apparatus or a copying machine.

BACKGROUND ART

A full-color image forming apparatus of an electrophotographic process type using an intermediary transfer belt has been conventionally known. Specifically, in the image forming apparatus, toner images on a photosensitive member obtained by development by a developing unit are once primary-transferred onto the intermediary transfer belt and then four color toner images on the intermediary transfer belt are collectively secondary-transferred onto a transfer material.

The intermediary transfer belt includes a plurality of rollers inside the belt and is in a state in which the belt is stretched by these rollers. One of the rollers is a driving roller. The driving roller is rotationally driven for rotating the belt. A frictional force acts between the driving roller and the belt and by this force; the belt is conveyed by following the driving roller. Further, at a primary transfer position where the photosensitive member and the intermediary transfer belt contact each other, a primary transfer member is provided inside the belt. This primary transfer member is urged toward the photosensitive member while sandwiching the intermediary transfer belt therebetween.

Further, in order to meet diversification of users in recent years, a speed of a secondary transfer step or a fixing step is changed depending on the type of paper which is the transfer material. For example, when thick paper or an OHP sheet is used as a transfer material P, it has been known that a process speed of the secondary transfer step and the fixing step is lowered to about ½ of that when plain paper is used. This causes, in the case where the toner is secondary-transferred onto the transfer material P such as thick paper, improper transfer since an electric field becomes small compared with the plain paper. Further, in the case of the fixing, a heat conduction manner is weaker than that for the plain paper and therefore improper fixing occurs. For that reason, this problem is addressed by lowering the speed thereby to prolong a nip passing time.

As one of methods of changing this speed during the fixing, a method in which operations until the primary transfer are carried out at a predetermined process speed and after all the toner images obtained on the photosensitive member by development are transferred onto the intermediary transfer belt, the process speed is switched and then the secondary transfer step and the fixing step are performed has been known. When the process speed is changed, speeds of the photosensitive member, the intermediary transfer belt and the fixing device are changed. In this case, in a constitution in which a distance between the primary transfer position and a secondary transfer position is shorter than an image size, when all the toner images are completely primary-transferred, a leading end of the toner images has been in a state in which it passes through a secondary transfer portion. For that reason, e.g., in Japanese Laid-Open Patent Application Hei 07-225520, after the primary transfer is completely ended, the speeds of the intermediary transfer belt and the fixing device are switched and then an operation for idling the intermediary transfer belt one full circumference in a state in which the toner images are held on the intermediary transfer belt is performed.

However, in the image forming apparatus as described above, when the speed of the intermediary transfer belt is switched during image formation, due to differences of a gear train and motors (driving source), a difference in speed between the photosensitive member and the intermediary transfer belt can occur. Further, also during the switching, there is a potential difference between the member and the intermediary transfer belt and by the potential difference, an attraction force acts between the member and the intermediary transfer belt.

For example, in the image forming apparatus with a constitution as shown in FIG. 7, when the speed of a photosensitive member is first decreased, an intermediary transfer belt 16 is braked by the attraction force between the member 1 and the intermediary transfer belt 16. By this, a torque which is more than a drivable level is generated, so that a driving roller 16*a* and the intermediary transfer belt 16 cause a slip therebetween. Further, on the other hand, the intermediary transfer belt 16 is first decreased in speed, the photosensitive member 1 pulls the intermediary transfer belt 16. At this time, the speed of the intermediary transfer belt 16 is faster than a feeding speed of the driving roller 16*a* and as a result, the driving roller 16*a* and the intermediary transfer belt 16 slip. When this slip occurs in a short time, a phenomenon that a position of the formed toner images and a position of the paper are not aligned with each other occurs. Further, once the slip is caused, a frictional force between the driving roller 16*a* and the intermediary transfer belt 16 is lowered and the driving roller 16*a* continuously slips at it is, so that the driving roller 16*a* was in a state, in some cases, in which it cannot normally rotate the intermediary transfer belt 16.

DISCLOSURE OF THE INVENTION

In an embodiment of the present invention, there is provided an image forming apparatus comprising: a photosensitive member; a charging unit for electrically charging a surface of the photosensitive member; an exposure unit for forming an electrostatic latent image by exposing the charged surface of the photosensitive member to light; a developing unit for developing the formed electrostatic latent image into a toner image; a rotatable endless intermediary transfer belt; a primary transfer member for primary-transferring the toner image from the photosensitive member onto the intermediary transfer belt at a primary transfer position; a secondary transfer member for secondary-transferring the toner image, primary-transferred on the intermediary transfer belt, onto a transfer material at a secondary transfer position; wherein the image forming apparatus is operable in a mode in which a speed of the intermediary transfer belt is changed after all of the toner images are primary-transferred on the intermediary transfer belt, and the toner image primary-transferred on the intermediary transfer belt is passed through the secondary transfer position and the primary transfer position in this order to reach the secondary transfer position, where the toner image is secondary-transferred onto the transfer material, and a controller for making, before the image forming apparatus is operated in the mode to change the speed of the intermediary transfer belt, a potential difference between the intermediary transfer belt and the photosensitive member at the primary transfer position smaller than a potential difference between the intermediary transfer belt and the photosensitive member when the toner image is primary-transferred from the photosensitive member onto the intermediary transfer belt.

BEST MODE FOR CARRYING OUT THE INVENTION

Embodiment 1

(General Structure of Image Forming Apparatus)

Figure 1:
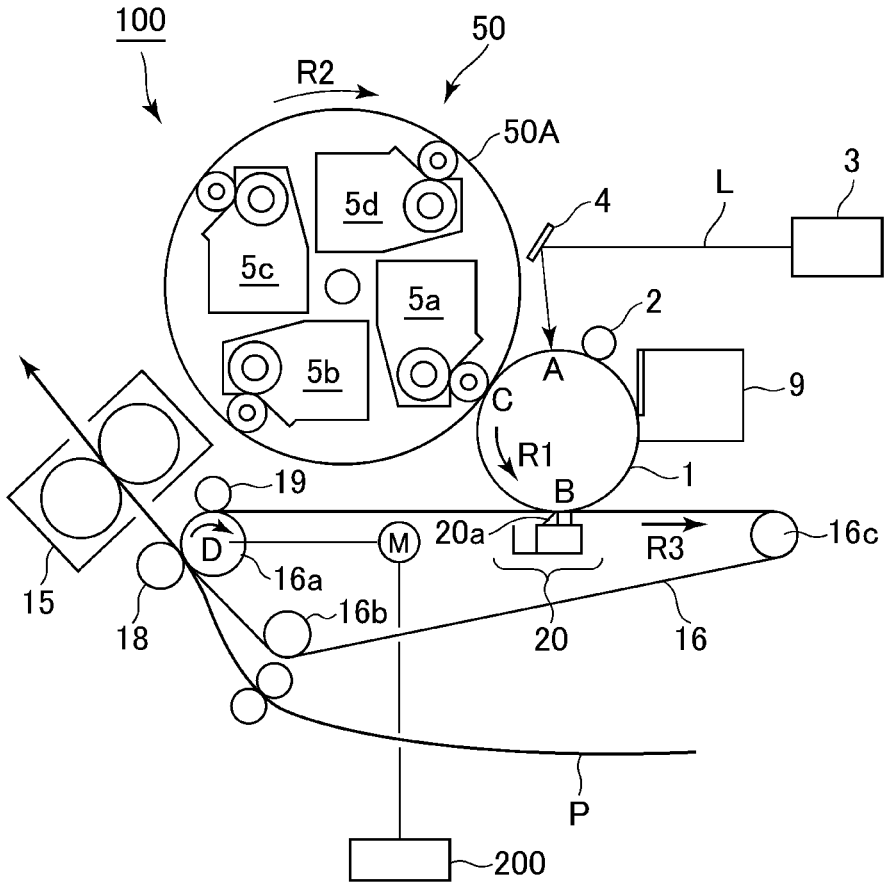
FIG. 1 is a schematic illustration of an embodiment of an image forming apparatus according to the present invention.

FIG. 1 shows a structure of an image forming apparatus 100 in this embodiment. In this embodiment, the image forming apparatus 100 is a full-color laser beam printer including a rotary type developing device 50.

The image forming apparatus 100 in this embodiment includes a drum-like electrophotographic photosensitive member (hereinafter, referred to as a "photosensitive drum") 1 which is an image bearing member. The photosensitive drum 1 rotates in an arrow R1 direction and around the photosensitive drum 1, a charging unit including a charging roller 2 and a laser beam scanning device (exposure unit) 3 are disposed. A laser beam L emitted from the exposure unit 3 reaches an exposure position A on the photosensitive drum 1 via a reflection mirror 4, so that the photosensitive drum 1 is exposed to light (laser beam L).

The rotary type developing unit 50 has a constitution in which developing devices 5*a*, 5*b*, 5*c* and 5*d* incorporating therein a yellow toner, a magenta toner, a cyan toner and a black toner, respectively, are detachably mountable. The respective developing devices 5*a*, 5*b*, 5*c* and 5*d* have the same internal constitution and therefore in the case where the incorporated toners are not particularly distinguished, appellations of the respective developing devices 5*a*, 5*b*, 5*c* and 5*d* are not distinguished but will be described in the following as a developing device 5.

All the developing devices 5 are configured to be detachably mountable to a supporting portion (rotary) 50A of the rotary type developing unit 50. The rotary 50A is rotatably supported in a state in which the developing devices 5 are mounted, and is capable of rotationally moving a desired developing device (e.g., the developing device 5*a*) in an R2 direction to a developing position C where the developing device is opposed and contacted to the photosensitive drum 1.

Under the photosensitive drum 1, the intermediary transfer belt 16 as an intermediary transfer member which is a transfer receiving member is stretched by three rollers 16*a*, 16*b* and 16*c* and is disposed so as to rotationally move in an R3 direction in FIG. 1.

The roller 16*a* which is one of the rollers for stretching the intermediary transfer belt 16 is a driving roller to which a driving force is transmitted from a driving source M. As the driving roller 16*a*, a roller member, of 30 mm in diameter, obtained by coating an A1 core metal with EPDM rubber in which carbon (black) is dispersed as an electroconductive agent and which has a resistance of $10^4$ Ω, a thickness of 1.0 mm and a high frictional force, is used. The driving roller 16*a* rotationally moves the intermediary transfer belt 16 by using the frictional force between the surface of the driving roller 16*a* and an inner surface of the intermediary transfer belt 16.

Other rollers are follower roller 16*c* and a tension roller 16*b*, and the tension roller 16*b* is urged by a tension applying means (not shown) such as a spring so as to apply a predetermined tension to the intermediary transfer belt 16. The tension is 19.6N on one side and is 39.2N in total.

At a primary transfer position B where the photosensitive drum 1 and the intermediary transfer belt 16 are urged against and contacted to each other, a primary transfer device 20 is disposed inside the intermediary transfer belt 16. A primary transfer sheet 20*a* constituting the primary transfer device 20 is disposed so as to sandwich the intermediary transfer belt 16 between itself and the photosensitive drum 1.

A secondary transfer roller 18 as a secondary transfer means is disposed opposed to the driving roller 16*a* to sandwich the intermediary transfer belt 16, thus constituting a secondary transfer position D. At the secondary transfer position D, the secondary transfer roller 18 is configured so that it can be contacted to/spaced from the intermediary transfer belt 16. At the secondary transfer position D, as described later, onto the transfer material (recording material) p which has been conveyed, the image is transferred. The recording material P after the transfer is sent to a fixing device 15.

Downstream of the secondary transfer position D with respect to a movement direction of the intermediary transfer belt 16, a charging roller 19 for electrically charging secondary transfer residual toner is provided. The charging roller 19 is disposed contactable to and separable from the intermediary transfer belt 16 in order to charge the secondary transfer residual toner. For the photosensitive drum 1, a photosensitive member cleaning unit 9 is provided downstream of the primary transfer position B with respect to a movement direction of the photosensitive drum 1, and an attached blade is disposed in contact with the photosensitive drum 1 so as to scrape the toner off the photosensitive drum 1.

(Constitution of Primary Transfer Device)

Figure 2:
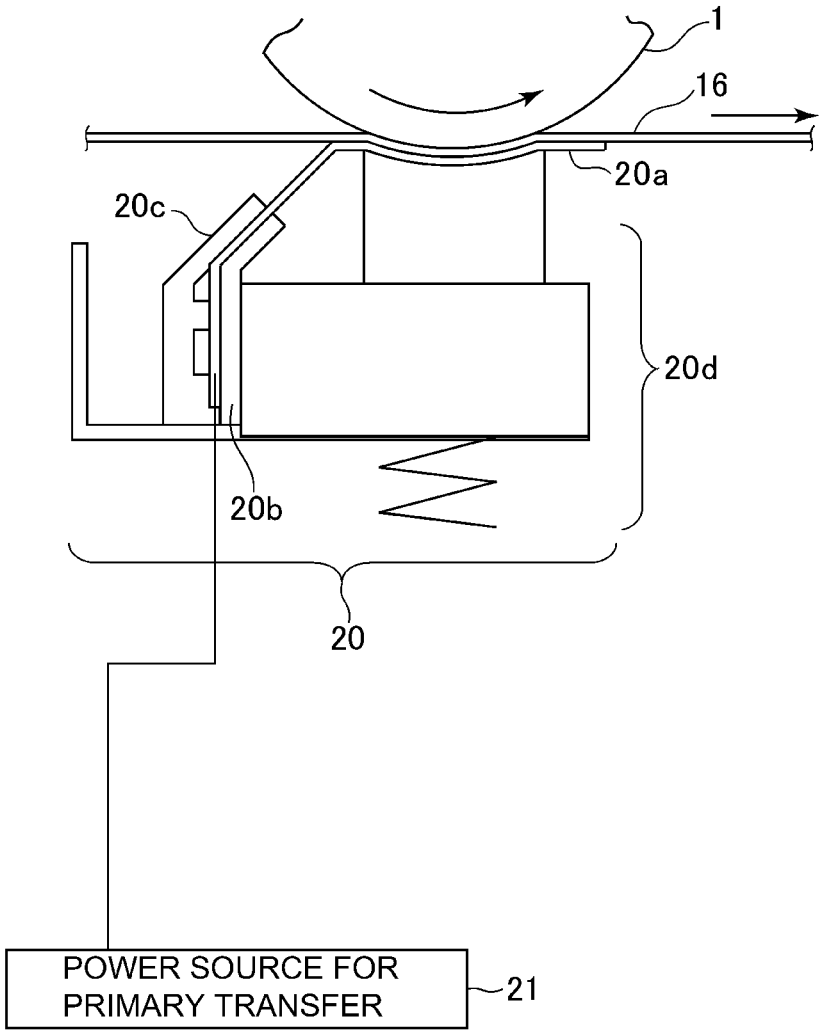
FIG. 2 is a schematic illustration of a primary transfer device.

With reference to FIG. 2, a constitution of the primary transfer device 20 which is a primary transfer means in this embodiment will be described.

The primary transfer device 20 is disposed at a side opposite from the photosensitive drum 1 while sandwiching the intermediary transfer belt 6, and includes a sheet-like transfer member 8 sheet member) 20*a* as a primary transfer member. The sheet member 20*a* is urged against the intermediary transfer belt 16 from a side opposite from the photosensitive drum 1 by an urging member 20*d* and is contacted to the intermediary transfer belt 16. Incidentally, in this embodiment, as the sheet member 20*a*, a sheet of ultra-high-molecular polyethylene with a longitudinal width of 230 mm is used.

A volume resistivity of this ultra-high-molecular polyethylene is $10^3$-$10^4$ Ωcm under application of 5 V and is not largely fluctuated from a low temperature and low humidity environment of 15° C. and 20% RH to a high temperature and high humidity environment of 30° C. and 80% RH.

Further, to the sheet member 20*a*, a power source 21 for primary transfer shown in FIG. 2 is connected. When the toner images are transferred from the photosensitive drum 1 onto the intermediary transfer belt 16, the transfer is effected by applying a transfer voltage from the power source 21 for primary transfer to the sheet member 20*a*. The sheet member 20*a* to which the transfer voltage is applied is electrostatically attracted to the intermediary transfer belt 16. The sheet member 20*a* is supported at one end portion side by being sandwiched between a sheet supporting member 20*b* and a sheet cover 20*c*. This sheet supporting member 20*b* and the sheet cover 20*c* are provided as a supporting means for the sheet member 20*a*.

In this embodiment, as the primary transfer member 20*a*, the sheet-shaped sheet member 20*a* is used but the primary transfer member 20*a* may also be a roller-shaped roller member and a pad-shaped pad member which have been conventionally well known by a person skilled in the art.

(Intermediary Transfer Belt)

As the intermediary transfer belt 16, a 60 μm-thick sheet of PEN (polyethylene naphthalate) having the volume resistivity of $10^6$-$10^{11}$ Ωcm can be used. In this embodiment, a belt circumferential length was 377 mm.

Next, an image forming operation of the image forming apparatus will be described.

The surface of the photosensitive drum 1 rotating in the arrow R1 direction in FIG. 1 at 100 mm/sec is charged to a predetermined potential by the charging roller 2 which is a charging member. Specifically, to the charging roller 2, a DC voltage from about −950 V to about −1200 V is applied, so that the photosensitive drum surface is charged to about −450 V to −600 V. At the exposure position A, an electrostatic latent image is formed on the photosensitive drum 1 by a laser beam L emitted depending on an image signal for each color by the exposure device 3 and the reflection mirror 4. The formed electrostatic latent image is developed by the developing device 5 at the developing position C, so that the toner image is formed. The developing device 5 provided at the developing position C is determined depending on the image signal for each color, and in advance, the rotary 50A is rotated in the arrow R2 direction to provide the developing device 5 for a desired color at the developing position C. The order of colors of the toner images obtained by development is also determined, and in this embodiment, the toner images are formed in the order of yellow, magenta, cyan and black. After an end of the developing operation, the rotary 50A is rotated immediately, so that the developing device 5 is spaced from the developing position C.

The toner images formed on the photosensitive drum 1 are transferred onto the intermediary transfer belt at the primary transfer position B. At this time, to the sheet member 20*a* which is the primary transfer member, a voltage of about 500-1200 V is applied. By successively superposing onto the transferred toner image(s), a subsequent toner image, a full-color toner image is formed on the intermediary transfer belt. The secondary transfer roller 18 and the secondary transfer residual toner charging roller 19 are spaced from the intermediary transfer belt 6 until the full-color toner image is formed and are contacted to the intermediary transfer belt 16 after the full-color toner image is formed. The recording material P is conveyed in synchronism with timing when the formed full-color toner image reaches the secondary transfer position D. The secondary transfer roller 18 and the driving roller 16*a* sandwich the recording material P together with the intermediary transfer belt 16 to transfer the full-color toner image onto the recording material P. The recording material P on which the full-color toner image is transferred is sent to the fixing device 15. The fixing device 15 presses and heats the full-color toner image on the recording material P to fix the full-color toner image on the recording material P, thus providing a final image.

The toner remaining on the transfer belt 16 after the secondary transfer is charged to the opposite polarity to a normal polarity of the toner by the secondary transfer residual toner charging roller 19 and is reversely transferred electrically onto the photosensitive drum 1 at the primary transfer position B. Thereafter, the toner is collected in the cleaning device provided for the photosensitive drum 1.

In the image forming apparatus 100 in this embodiment, the process speed in the secondary transfer or later is variably controlled depending on a normal mode (first mode) in which the recording material P used is the plain paper and a thick paper mode (second mode) in which the recording material P used is the thick paper or the OHP sheet. An image forming apparatus controller 200 shown in FIG. 3 includes a CPU and is capable of effecting control of the driving motor, control of the charging bias, control of the primary transfer bias and control of the exposure. Further, correspondingly to a change between the normal mode and the thick paper mode, control of the process speed or the like is also effected by the image forming apparatus controller 200.

Figure 3:
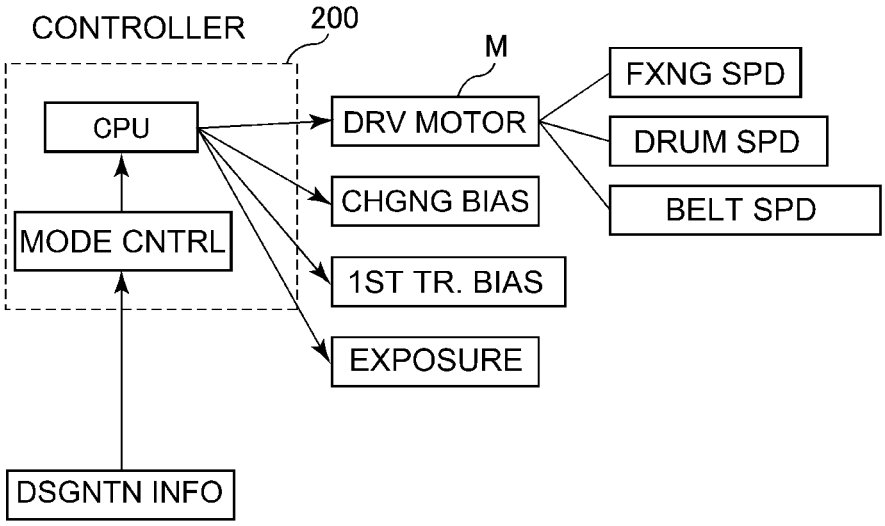
FIG. 3 is a block diagram showing a constitution of a controller (contact portion) of the image forming apparatus.

Specifically, as shown in FIG. 3, when the type of the recording material P is designated by a user in the image forming apparatus 100, the controller judges that the mode is the thick paper mode and contacts the driving motor M for providing a rotational force to the fixing device 15, the driving roller 16*a* and the photosensitive drum 1 so that the process speed is, e.g., ½ of that in the normal mode. Herein, the paper type is judged by designating the paper type by the user but a manner of the judgment is not limited thereto. It is also possible to automatically judge the paper type if a paper type detecting portion or the like can be provided.

As described above, in the case where the image formation is effected in the thick paper mode, a process speed (V2) during the secondary transfer is required to be ½ of a process speed (V1) in the normal mode. That is, in a period from the end of the primary transfer of all the four color toner images onto the intermediary transfer belt 16 until the toner images are secondary transferred onto the recording material P, the process speed is required to be dropped to V2.

In the constitution in this embodiment, in order to achieve the downsizing of the apparatus, a distance between the primary transfer position B and the secondary transfer position D is shorter than a length of A4-sized paper. For that reason, with timing when all the toner images are completely primary-transferred and then the process speed is lowered to V2, a leading end of the toner images has already passed through the secondary transfer position B. Therefore, the intermediary transfer belt 16 is idled one-full-circumference after the process speed is lowered to V2, and the secondary transfer onto the recording material P is effected when the leading end of the toner images reaches the secondary transfer position D again. Finally, until all the fixing step is ended, at least the process speed is in a state in which it is kept at V2.

Naturally, the switching of the process speed is required to complete until the leading end of the toner images reaches the primary transfer position B again during the above-described idling of the intermediary transfer belt 16. This is because when the process speed is switched during the passing of the toner images through the primary transfer position B, the toner images can be disturbed due to a speed difference, described later, between the photosensitive drum 1 and the intermediary transfer belt 16.

When the process speed switching as described above is carried out, such a phenomenon that slip occurred between the driving roller 16*a* and the intermediary transfer belt 16 and thus the intermediary transfer belt 16 was unable to be rotationally moved was caused to occur.

Figure 4:
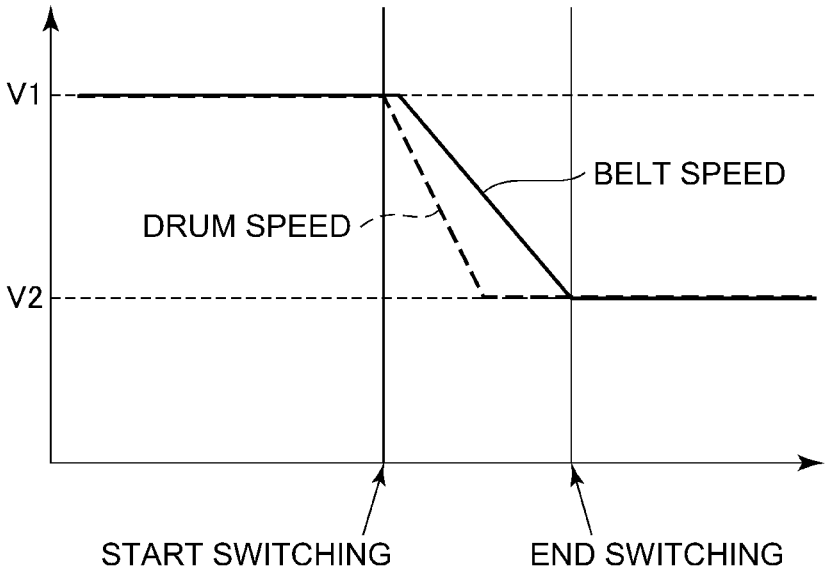
FIG. 4 is a graph showing a speed difference between a photosensitive drum and an intermediary transfer belt during process speed switching.

With respect to the occurrence of the above phenomenon, it was found by study of the present inventors that there are two factors. A first factor will be described. When the process speed switching is carried out, although the speeds of the photosensitive drum 1 and the intermediary transfer belt 16 are switched at the same time, due to a difference of the gear train, a speed difference between the photosensitive drum 1 and the intermediary transfer belt 16 is caused. As shown in FIG. 4, timing until the process speed becomes a constant speed and a profile of a slope are different from each other. In the case of this embodiment, the photosensitive drum 1 is first decreased in speed and then the intermediary transfer belt 16 is decreased in speed. This speed difference between the photosensitive drum 1 and the intermediary transfer belt 16 during the speed switching is the first factor.

Next, a second factor will be described. When there is a potential difference between the develop surface and the intermediary transfer belt surface, it is known that the intermediary transfer belt 16 is electrostatically attracted to the photosensitive drum 1. This attraction force depends on the potential difference and is increased with a larger potential difference. This attraction force due to the potential difference is the second factor.

Even when the attraction force is a high state, if the photosensitive drum 1 and the intermediary transfer belt 16 are rotationally moved at the substantially same speed, the driving roller 16*a* and the intermediary transfer belt 16 do not cause the slip. On the other hand, even when there is the speed difference between the photosensitive drum 1 and the intermediary transfer belt 16, if there is no potential difference between the photosensitive drum 1 and the intermediary transfer belt 16, the slip is not caused. However, when the factors 1 and 2 are combined, the slip occurs in the following mechanism.

In the constitution of the image forming apparatus as shown in FIG. 1, as shown in FIG. 4, when the speed of the develop 1 is first decreased, the intermediary transfer belt 16 is braked by the attraction force between the photosensitive drum 1 and the intermediary transfer belt 16. By this, a torque which exceeds a range in which the driving roller 16*a* can convey the intermediary transfer belt 16 is generated. Then, the driving roller 16*a* and the intermediary transfer belt 16 cause the slip.

It is very difficult to eliminate the speed difference between the photosensitive drum 1 and the intermediary transfer belt 16. In this embodiment, by transmitting the driving force from the same driving motor, the above-described was eliminated as small as possible but the speed difference was caused due to the difference of the gear train. Further, it would be considered that the control is effected by using separate driving sources but it is difficult to completely eliminate the speed difference when a variation in driving motor or the like is taken into consideration.

(Experimental Result)

Therefore, the present inventors noted a decrease of the potential difference between the develop 1 and the intermediary transfer belt 16 and conducted an experiment. An experimental result is shown in Table 1.

TABLE 1

| NO. | CHARGING BIAS | FORCED EMISSION | PRIMARY TRANSFER BIAS | SLIP |
|---|---|---|---|---|
| A | ON | NO | ON | x |
| B | ON | NO | OFF | ○ |

TABLE 1-continued

| NO. | CHARGING BIAS | FORCED EMISSION | PRIMARY TRANSFER BIAS | SLIP |
|---|---|---|---|---|
| C | ON | YES | ON | ○ |
| D | OFF | NO | ON | ○ |
| E | OFF | YES | ON | ○ |
| F | OFF | NO | OFF | ○ |
| G | ON | YES | OFF | ○ |
| H | OFF | YES | OFF | ○ |

In the table, ON/OFF of the "CHARGING BIAS" shows whether or not a voltage is applied to the charging roller (charging bias: ON). Specifically, the charging bias ON shows that a voltage of −950 to −1250 V used during the image formation is applied. OFF shows a state in which the above voltage is not applied. YES/NO of the "FORCED EMISSION" shows either or not the photosensitive drum surface is forcedly exposed to light (forced exposure: YES) by the exposure unit 3. ON/OFF of "PRIMARY TRANSFER BIAS" shows whether or not a voltage is applied (primary transfer bias: ON) to the primary transfer member (sheet member) 20*a*. Specifically, the charging bias ON shows that the voltage of 500 to 1200 V used when the primary transfer is effected during the image formation is applied. OFF shows a state in which the above voltage is not applied. "SLIP" represents the slip between the driving roller 16*a* and the intermediary transfer belt 16, and "x" shows a state in which the intermediary transfer belt 16 is completely slipped and is not conveyed and thus the image cannot be outputted or a state in which the intermediary transfer belt 16 is slipped in a short time and thus the image is somewhat deviated with respect to the paper in a conveyance direction (i.e., out of a tolerable range on the image). "o" shows a state in which a problem on the image due to the slip does not occur.

OFF of the charging direction and the primary transfer bias is not limited to a state in which the biases are completely 0 V but may also include a state in which the biases are made smaller than the voltages, in terms of an absolute value, applied during the image formation.

With respect to the charging bias: OFF and the forced exposure: YES in the table, after the photosensitive drum surface subjected to these operations reaches the primary transfer position B, the process speed is switched. The primary transfer bias is turned off (OFF) before the process speed switching.

In the table, a condition for A is that during the image formation (until the end of the primary transfer step). When the process speed was switched under this condition as it was, the slip occurred in some cases. However, in the table, there was no occurrence of the slip with respect to B to H, so that it became possible to output a very good image. By this, it was understood that all the operations of the charging bias OFF, the forced emission and the primary transfer bias OFF individually have the effect on the slip.

First, the photosensitive drum surface potential (photosensitive member surface potential) is noted and the action of each of the conditions will be described. By turning the charging bias off (OFF), the photosensitive drum surface (photosensitive member surface) after the end of the primary transfer is not charged again and therefore an absolute value of the potential at the photosensitive drum surface is in a state in which it is lower than that during the normal image formation. Further, in the state of the charging bias ON, by performing the forced emission, the absolute value of the photosensitive drum surface potential is in a state in which it is not more than that during the image formation. Further, the photosensitive drum surface which has passed in the charging bias OFF state is forcedly exposed to light, so that the photosensitive drum potential can be lowered to the neighborhood of substantially 0 V. By these effects, the potential difference between the photosensitive drum and the intermediary transfer belt is smaller than that during the image formation.

Further, it is clear that the potential difference between the photosensitive drum 1 and the intermediary transfer belt 16 is smaller than that in the ON state. That is, one or both of the voltage applied to the primary transfer member 20*a* and the photosensitive drum surface potential are controlled, so that the direction in potential between the primary transfer member 20*a* and the photosensitive drum surface can be made small.

As described above, with respect to B to H in the table, compared with A, the potential difference between the photosensitive drum 1 and the intermediary transfer belt 16 becomes small. By that, the electrostatic attraction force between the photosensitive drum 1 and the intermediary transfer belt 16 is lowered, so that the slip is suppressed.

In the following, an embodiment of a process speed switching sequence will be described as Embodiment A and Embodiment B.

(Embodiment A)

Figure 5:
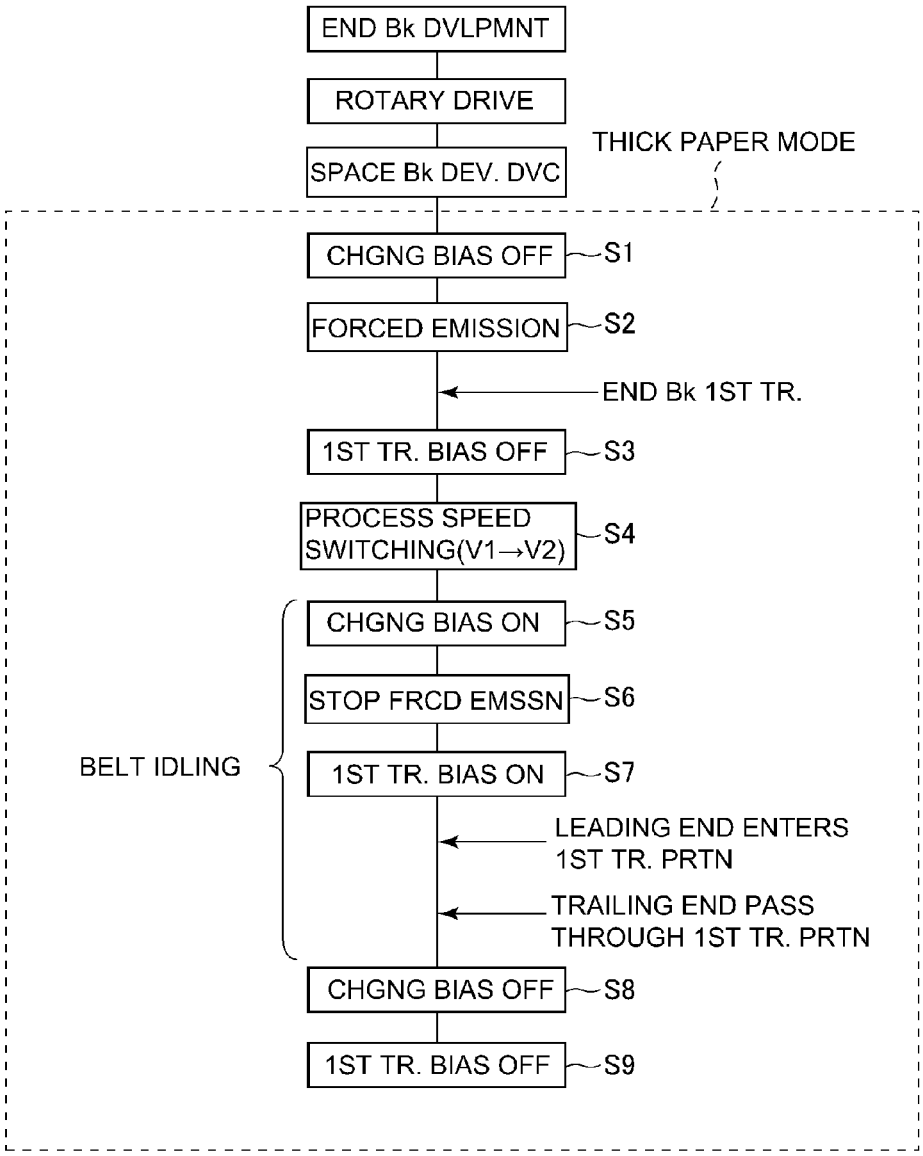
FIG. 5 is a flow chart during the process speed switching in an embodiment.

A process speed switching sequence, in the thick paper made, which is a characteristic feature of the present invention in this embodiment will be described. In the thick paper mode, in order to decrease the potential difference between the photosensitive drum 1 and the intermediary transfer belt 16 as small as possible, the following sequence is carried out. This will be described by using FIG. 5.

After the end of the development for the final image formation color (Bk) in this embodiment, the developing device for black (Bk) is spaced from the developing position C by the rotation of the rotary and thereafter the voltage applied to the charging roller is turned off (OFF) (S1: charging bias OFF operation). Then, the photosensitive drum surface is forcedly exposed to light (S2: forced emission operation), so that the toner at the photosensitive drum surface (photosensitive member surface) is lowered to nearly 0 V. Further, after all the toner images are completely primary-transferred, the voltage applied to the primary transfer member 20*a* is turned off (OFF) (S3: primary transfer bias OFF operation). After the primary transfer bias is turned off (OFF), the process speed is switched from V1 to V2 and thus the speed changed of the process speed is made (S4).

In a constitution in this Embodiment A, after the process speed is switched, in a state in which the toner images are held, the intermediary transfer belt 16 is idled one-full-circumference.

That is, after the process speed is changed, the charging bias is applied (S5) to charge the photosensitive drum surface, and the forced emission operation is stopped (S6), and thereafter, the primary transfer bias is applied (S7). This state is continued until all the toner images completely pass through the primary transfer portion.

After the process speed change, the secondary transfer step and the fixing step are performed in parallel to these sequences. After the image output, the applied voltages such as the charging bias and the primary transfer bias are turned off with predetermined timing.

The order of the charging bias OFF operation in S1 and the forced emission operation in S2 may be which operation is first performed but when the photosensitive drum surface subjected to either one of the operations reaches the developing position C, the developing device 5 is required to be spaced from the developing position D with reliability. By keeping the developing device 5 being spaced from the developing position C with reliability, even when the potential at the photosensitive drum surface is lowered to nearly 0 V by performing the above-described two operations, a problem such as fog does not occur.

Further, the primary transfer bias OFF operation in S3 may desirably be performed after the photosensitive drum surface lowered in surface potential as described above reaches the primary transfer position B. This is because when the operation is performed before this timing, the potential of the photosensitive drum 1 cannot be lowered at the primary transfer position B and is in a state in which the photosensitive drum surface potential is left.

By turning the charging bias on (ON) in S5 and stopping the forced emission in S6, the photosensitive drum surface potential is placed in a state similar to that during the image formation. Timing of S5 and S6 is required such that the photosensitive drum surface charged to the potential during this image formation reaches the primary transfer position B before the toner images reach the primary transfer position B by the idling of the intermediary transfer belt 16. Further, the turning-on (ON) of the primary transfer bias in S7 is required to be performed before the toner images pass through the primary transfer position B again. These are because when the intermediary transfer belt 16 is idled and thereby the toner images pass through the primary transfer position B again, the reverse transfer of the toner images is suppressed by providing a predetermined potential difference between the photosensitive drum 1 and the intermediary transfer belt 16.

At this time, the voltage applied to the primary transfer member 20*a* may desirably be a voltage weaker than that when the primary transfer is effected. This is because the toner images have already been present on the intermediary transfer belt 16 and therefore the potential difference capable of retaining the toner images may only be required to be obtained. When this potential difference is excessively large, reverse charging of the toner images occurs, so that the toner is transferred onto the photosensitive drum. The reverse charging of the toner images is suppressed by decreasing this potential difference, so that an effect of suppressing the transfer of the toner onto the photosensitive drum 1 is achieved.

By employing the constitution in this Embodiment A, it became possible to lower the attraction force between the photosensitive drum 1 and the intermediary transfer belt 16 by minimizing the potential difference between the photosensitive drum 1 and the intermediary transfer belt 16 during the process speed switching. Therefore, even if the speed difference was generated between the photosensitive drum 1 and the intermediary transfer belt 16 during the process speed switching, a force by which the intermediary transfer belt 16 is pulled to the photosensitive drum 1 was weak and therefore it became possible to suppress the slip between the driving roller 16*a* and the intermediary transfer belt 16.

(Embodiment B)

Figure 6:
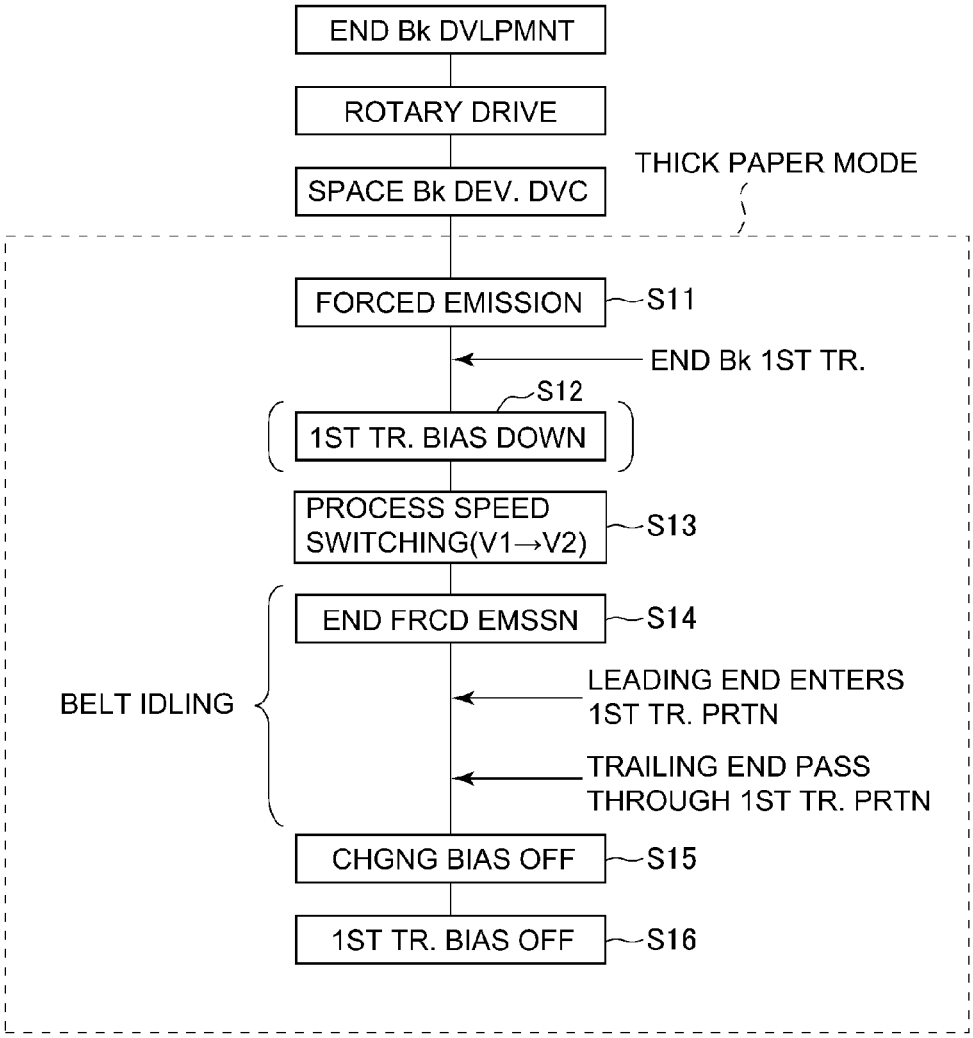
FIG. 6 is a flow chart during process speed switching in another embodiment.
Figure 7:
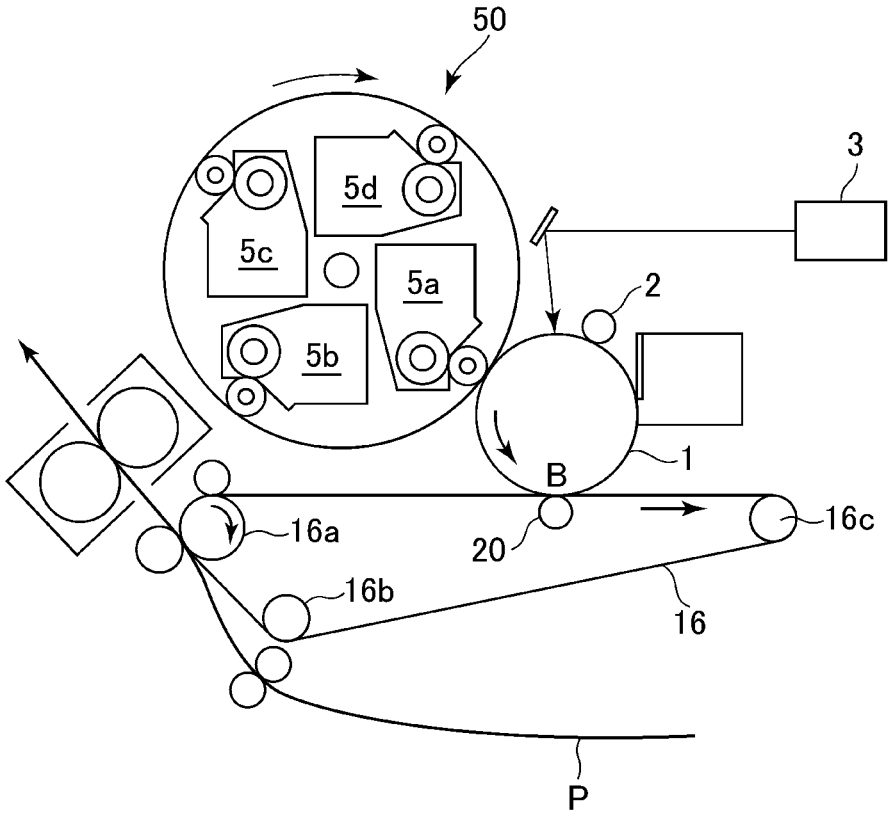
FIG. 7 is a schematic illustration of a conventional image forming apparatus.

A second embodiment in a process speed switching sequence which is a characteristic feature of the present invention will be described by using FIG. 6.

After the end of the development for the final image formation color (Bk), the developing device 5 for black is spaced from the developing position C by the rotation of the rotary and thereafter the photosensitive drum surface is forced exposed to light (S11: forced emission operation), so that an absolute value of the potential at the photosensitive drum surface is made smaller than that during the normal image formation. Thereafter, all the toner images are completely primary-transferred and then, the voltage applied to the primary transfer member 20*a* is switched to a bias which is about ⅔ time that during the normal image formation (S12: primary transfer bias switching operation). After the primary transfer bias is switched, the exposed surface of the photosensitive drum 1 reaches the primary transfer position and then the process speed is switched from V1 to V2 (S13). After the switching, the forced emission operation is stopped (S14).

In a constitution in this Embodiment B, after the process speed is switched, in a state in which the toner images are held, the intermediary transfer belt 16 is idled one-full-circumference.

After the process speed switching, the secondary transfer step and the fixing step are performed in parallel to these sequences. After the image output, the applied voltages such as the charging bias and the primary transfer bias are turned off with predetermined timing, and also the driving motor M is stopped (S15, S16).

The step in S12 is not performed in some cases depending on the applied voltage.

By performing the sequence in this Embodiment B, the potential difference between the photosensitive drum 1 and the intermediary transfer belt 16 was able to be made small during the process speed switching, so that it became possible to lower the attraction force between the develop 1 and the intermediary transfer belt 16. As a result, it became possible to suppress the slip between the driving roller 16*a* and the intermediary transfer belt 16.

The sequence in this Embodiment B is particularly effective in a constitution in which the distance between the primary transfer position B and the secondary transfer position D is small (close) by the downsizing and thus a time usable for switching the process speed is short. For example, when the time usable for switching the process speed, such as in the case where sensitivity of ON and OFF of the voltage output is low (slow), there is a possibility that all the operations in the above-described Embodiment A are not ended within the time. In such a situation, when a leading end of the toner images passes through the primary transfer position B, a desired potential difference cannot be provided between the photosensitive drum 1 and the intermediary transfer belt 16, so that the reverse transfer of the toner occurs. However, in the sequence in this Embodiment B, there is no need to apply the charging bias and the primary transfer bias again and therefore, the problem as described above is not caused.

[Industrial Applicability]

An image forming apparatus capable of suppressing the slip between the driving roller and the intermediary transfer belt during the speed switching and capable of forming a good image is provided.

The invention claimed is:

1. An image forming apparatus comprising:

a photosensitive member;

a charging unit for electrically charging a surface of said photosensitive member;

an exposure unit for forming an electrostatic latent image by exposing the charged surface of said photosensitive member to light;

a developing unit for developing the formed electrostatic latent image into a toner image;

a rotatable endless intermediary transfer belt;

a primary transfer member for primary-transferring the toner image from said photosensitive member onto said intermediary transfer belt at a primary transfer position;

a secondary transfer member for secondary-transferring the toner image, primary-transferred on said intermediary transfer belt, onto a transfer material at a secondary transfer position, wherein said image forming apparatus is operable in a mode in which a speed of said intermediary transfer belt is changed after all of the toner images are primary-transferred onto said intermediary transfer belt, and the toner image primary-transferred on said intermediary transfer belt is passed through the secondary transfer position and the primary transfer position in this order to reach the secondary transfer position, where the toner image is secondary-transferred onto the transfer material; and a controller for making, before said image forming apparatus is operated in the mode to change the speed of said intermediary transfer belt, a potential difference between said intermediary transfer belt and said photosensitive member at the primary transfer position smaller than a potential difference between said intermediary transfer belt and said photosensitive member when the toner image is primary-transferred from said photosensitive member onto said intermediary transfer belt.

2. An image forming apparatus according to claim 1, further comprising a fixing unit for fixing the toner image secondary-transferred on the transfer material, wherein a speed of said fixing unit is equal to the speed of said intermediary transfer belt.

3. An image forming apparatus according to claim 1, wherein said image forming apparatus is operated in the mode in the case where the transfer material is thick paper.

4. An image forming apparatus according to claim 1, wherein said developing unit includes a plurality of developing devices and is a rotary type developing unit in which a desired one of the developing devices is opposed to said photosensitive member by being rotated.

5. An image forming apparatus according to claim 4, wherein in the case where said image forming apparatus is operated in the mode, said controller stops application of a bias to said charging unit after development by the developing devices is ended and then said photosensitive member is exposed to light by said exposure unit to decrease the potential difference between said intermediary transfer belt and said photosensitive member at the primary transfer position.

6. An image forming apparatus according to claim 5, wherein timing when the speed of said intermediary transfer belt is changed in the case where said image forming apparatus is operated in the mode is after an exposure surface by said exposure unit reaches the primary transfer position.

7. An image forming apparatus according to claim 1, wherein said primary transfer member is a sheet member, which is electrostatically attracted to said intermediary transfer belt.

8. An image forming apparatus according to claim 1, wherein said primary transfer member is a roller member or a pad member.

9. An image forming apparatus according to claim 1, wherein said image forming apparatus is capable of forming a color image.

* * * * *